US010498110B2

(12) United States Patent
Sumoyama et al.

(10) Patent No.: US 10,498,110 B2
(45) Date of Patent: Dec. 3, 2019

(54) SPARK PLUG

(71) Applicant: NGK SPARK PLUG CO., LTD., Nagoya-shi, Aichi (JP)

(72) Inventors: Daisuke Sumoyama, Nagoya (JP); Kazuki Ito, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/285,463

(22) Filed: Feb. 26, 2019

(65) Prior Publication Data

US 2019/0288487 A1 Sep. 19, 2019

(30) Foreign Application Priority Data

Mar. 13, 2018 (JP) ..... 2018-044862

(51) Int. Cl.
*H01T 13/39* (2006.01)

(52) U.S. Cl.
CPC ..... *H01T 13/39* (2013.01)

(58) Field of Classification Search
CPC ..... H01T 13/39; H01T 13/20
See application file for complete search history.

(56) References Cited

U.S. PATENT DOCUMENTS 8,841,826 B2 * 9/2014 Kasuya ..... H01T 13/39 313/141
2013/0313962 A1 11/2013 Yoshimoto et al.
2015/0340844 A1 * 11/2015 Yoshimoto ..... H01T 13/39 313/141
2015/0357797 A1 12/2015 Yoshimoto
2016/0053733 A1 * 2/2016 Aochi ..... H01T 13/02 313/120
2017/0125981 A1 * 5/2017 Suzuki ..... H01T 13/20
2018/0019578 A1 * 1/2018 Mukoyama ..... H01T 13/08

FOREIGN PATENT DOCUMENTS

JP 2002-235139 A 8/2002
JP 2011-18612 A 1/2011
JP 2011-96543 A 5/2011
JP B2-5662622 12/2014

OTHER PUBLICATIONS

Extended European Search Report from corresponding European Patent Application No. 19160984.1, dated Jul. 30, 2019.

* cited by examiner

*Primary Examiner* — Donald L Raleigh
(74) *Attorney, Agent, or Firm* — Kusner & Jaffe

(57) ABSTRACT

A spark plug including a center electrode with a tip welded to a front end portion with a fused portion therebetween. The front end portion contains Ni, Cr, and at least one element selected from a group B consisting of Mn, Si, Al, Ti, rare earth elements, Hf, and Zr. Ni is present in the largest proportion, and Cr is present in the second largest proportion and in an amount of 12% by mass or more. The at least one element selected from the group B is present in a total amount of 0.1% by mass or more. The front end portion satisfies f/e≤0.15 and m/e≤0.015, where f is the Fe content, e is the sum of the Cr, Si, and Al contents, and m is the Mo content.

8 Claims, 2 Drawing Sheets

SPARK PLUG

RELATED APPLICATIONS

This application claims the benefit of Japanese Patent Application No. 2018-044862, filed Mar. 13, 2018, the entire content of which is incorporated herein by reference.

FIELD OF THE INVENTION

The present invention relates to spark plugs, and particularly to a spark plug having a tip welded to a center electrode.

BACKGROUND OF THE INVENTION

In the field of spark plugs, Japanese Patent No. 5662622 discloses a technique in which a tip is welded to an electrode based on Ni and containing Cr and Fe. According to the technique disclosed in Japanese Patent No. 5662622, an oxide film mainly formed by Cr ensures that the electrode has sufficient oxidation resistance. Fe alleviates the stress in the electrode due to the difference in thermal expansion coefficient between the tip and the electrode.

However, the above technique in the related art has the following problem. As the heat rating of the spark plug becomes higher, the center electrode undergoes a larger temperature change, and the oxide film peels off more easily due to the thermal expansion of the center electrode. As a result, the center electrode may corrode due to sulfur remaining in fuel and may thus wear quickly.

The present invention has been made to address the foregoing problem. An advantage of the present invention is a spark plug including a center electrode with improved wear resistance.

SUMMARY OF THE INVENTION

In accordance with a first aspect of the present invention, there is provided a spark plug that includes an insulator having formed therein an axial hole extending from front to rear in a direction along an axial line, the insulator including a stop portion overhanging radially outward; a metal shell disposed around the insulator and including a stepped portion protruding radially inward, the stepped portion stopping the stop portion from a front side thereof directly or with another member therebetween; and a center electrode disposed in the axial hole. The center electrode includes a front end portion located forward of a front end of the insulator and a tip welded to the front end portion with a fused portion therebetween.

The front end portion contains Ni, Cr, and at least one element selected from a group B consisting of Mn, Si, Al, Ti, rare earth elements, Hf, and Zr. Ni is present in the largest proportion. Cr is present in the second largest proportion and in an amount of 12% by mass or more. The at least one element selected from the group B is present in a total amount of 0.1% by mass or more. The front end portion satisfies $f/e \leq 0.15$ and $m/e \leq 0.015$, where f is the Fe content, e is the sum of the Cr, Si, and Al contents, and m is the Mo content. The spark plug has a distance D of 22 mm or less in the direction along the axial line from a first point located at the frontmost position of a boundary between an outer surface of the front end portion and an outer surface of the fused portion to a second point located at the frontmost position of a contact area between the stepped portion or the other member and the stop portion.

Since the spark plug described above has a distance D of 22 mm or less in the direction along the axial line from the first point located at the frontmost position of the boundary between the outer surface of the front end portion and the outer surface of the fused portion of the center electrode to the second point located at the frontmost position of the contact area between the stepped portion of the metal shell or another member and the stop portion of the insulator, the front end portion tends to undergo a large temperature change during cooling. Thus, an oxide film formed on the front end portion would peel off easily due to the difference in thermal expansion coefficient between the front end portion and the oxide film.

However, the front end portion contains Ni, Cr, and at least one element selected from the group B consisting of Mn, Si, Al, Ti, rare earth elements, Hf, and Zr. Ni is present in the largest proportion, and Cr is present in the second largest proportion and in an amount of 12% by mass or more. Thus, even if the oxide film on the front end portion peels off, the oxide film forms easily again. In addition, since the group B is present in an amount of 0.1% by mass or more, a group B oxide or nitride film forms easily under the oxide film. Thus, even if the oxide film peels off, the oxidation of the front end portion and its corrosion due to sulfur can be inhibited.

Since the front end portion satisfies $f/e \leq 0.15$ and $m/e \leq 0.015$, where f is the Fe content, e is the sum of the Cr, Si, and Al contents, and m is the Mo content, Fe and Mo, which corrode easily, are present in relatively small proportions. As a result, a dense, continuous oxide film forms easily. In addition, since Cr is present in an amount of 12% by mass or more, chromium sulfide, although it forms at a lower rate than other sulfides, can inhibit the corrosion of the front end portion due to sulfur. Thus, the wear resistance of the center electrode can be improved.

According to a second aspect of the present invention, there is provided a spark plug as described above, wherein the tip of the spark plug contains Ir in the largest proportion and at least one element selected from a group A consisting of Pt, Ru, Rh, and Ni in an amount of 4% by mass or more. Thus, the stress in the front end portion due to the difference in thermal expansion coefficient between the front end portion and the tip can be reduced. As a result, the oxide film on the front end portion is less likely to fracture. Thus, the wear resistance can be further improved in addition to providing the advantages of the spark plug described above.

According to a third aspect of the present invention, there is provided a spark plug as described above, wherein the front end portion of the spark plug has a region where a plurality of crystal grains appear in a cross-section containing the axial line. The front end portion satisfies $Ha/Hb \geq 0.36$, where Ha is the Vickers hardness of the region in the cross-section after heat treatment at 900° C. in an Ar atmosphere for 50 hours, and Hb is the Vickers hardness of the region in the cross-section before the heat treatment. Thus, recrystallization and grain growth at high temperature can be inhibited. In addition, the length of the crystal grains in the direction along the axial line (referred to as X) is longer than the length of the crystal grains in the direction perpendicular to the axial line (referred to as Y). Accordingly, the length of the grain boundaries connecting to each other in the direction perpendicular to the axial line is longer than if $X \leq Y$. As a result, intergranular corrosion can be retarded in the direction perpendicular to the axial line. Thus, the likelihood of the front end portion fracturing due to intergranular corrosion at high temperature can be reduced in addition to providing the advantages of the spark plugs described above.

According to a fourth aspect of the present invention, there is provided a spark plug as described above, wherein the spark plug has a distance D of 18 mm or less.

According to a fifth aspect of the present invention, there is provided a spark plug as described above, wherein the spark plug has a distance D of 14 mm or less. In these cases, the front end portion tends to undergo a larger temperature change, and the oxide film on the front end portion peels off more easily. Thus, it is more effective to apply the present invention.

According to a sixth aspect of the present invention, there is provided a spark plug as described above, wherein the spark plug satisfies $f/e \leq 0.04$.

According to a seventh aspect of the present invention, there is provided a spark plug as described above, wherein the spark plug satisfies $m/e \leq 0.004$.

According to an eighth aspect of the present invention, there is provided a spark plug as described above, wherein the spark plug satisfies $f/e \leq 0.001$. This can increase the density of the oxide film and can further improve the continuity of the oxide film. Thus, the wear resistance of the front end portion can be further improved.

DETAILED DESCRIPTION OF THE PREFERRED EMBODIMENTS

Figure 1:
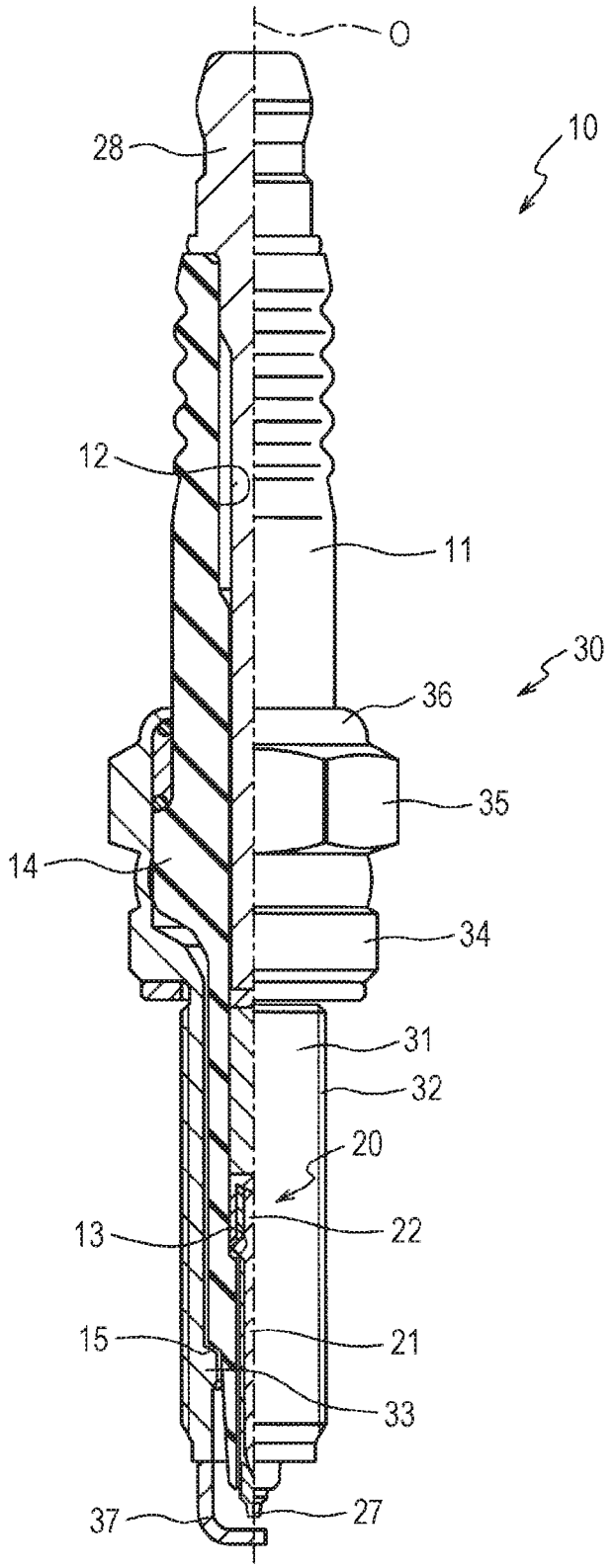
FIG. 1 is a half-sectional view of a spark plug according to one embodiment.
Figure 2:
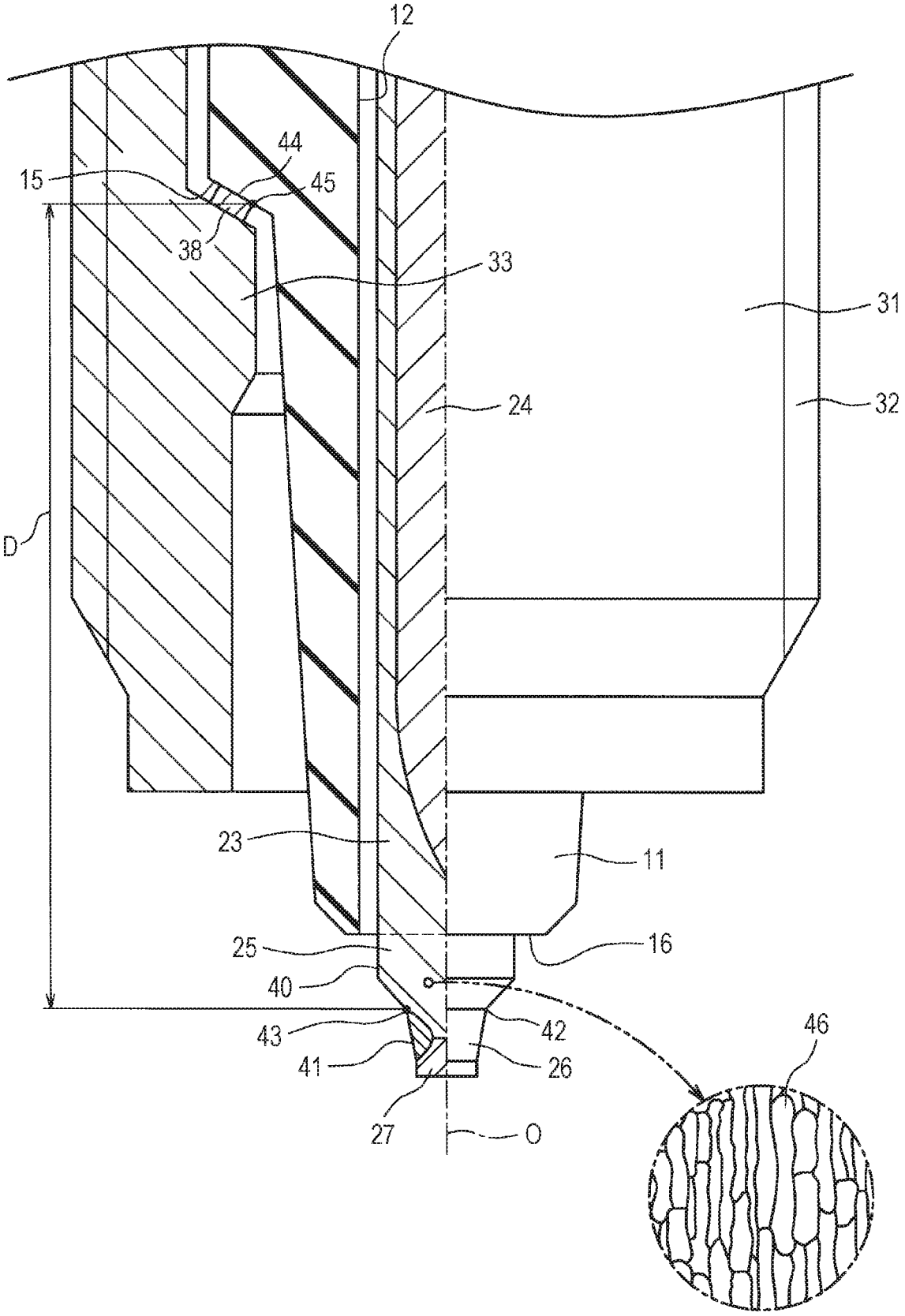
FIG. 2 is an enlarged half-sectional view of a portion of the spark plug in FIG. 1.

A preferred embodiment of the present invention will hereinafter be described with reference to the attached drawings. FIG. 1 is a half-sectional view of a spark plug 10 according to one embodiment taken along an axial line O. FIG. 2 is an enlarged half-sectional view of a portion of the spark plug 10 in FIG. 1. In FIGS. 1 and 2, the front side of the spark plug 10 faces the lower side of the page, whereas the rear side of the spark plug 10 faces the upper side of the page. In FIG. 2, a ground electrode 37 is not shown.

As shown in FIG. 1, the spark plug 10 includes an insulator 11 and a center electrode 20. The insulator 11 is a substantially cylindrical member formed of, for example, alumina, which exhibits good mechanical properties and insulating properties at high temperature. The insulator 11 has an axial hole 12 extending therethrough along the axial line O. A rearward-facing surface 13 facing rearward is formed on the front side of the axial hole 12 over the entire circumference thereof. A large-diameter portion 14 having the largest outer diameter is formed in the center of the insulator 11 in the direction along the axial line O. A stop portion 15 overhanging radially outward is formed forward of the large-diameter portion 14 of the insulator 11. The diameter of the stop portion 15 becomes smaller toward the front side.

The center electrode 20 is a rod-like member disposed in the axial hole 12. The center electrode 20 includes a shaft 21 disposed forward of the rearward-facing surface 13 in the axial hole 12 and a head 22 stopped by the rearward-facing surface 13. A portion of the shaft 21 protrudes out of the axial hole 12.

As shown in FIG. 2, the center electrode 20 includes a core material 24 with good thermal conductivity embedded in a base material 23. In this embodiment, the base material 23 is formed of a Ni-based alloy, whereas the core material 24 is formed of copper or a copper-based alloy. The core material 24 may be omitted.

A portion of the shaft 21 protrudes out of the axial hole 12; thus, the center electrode 20 includes a front end portion 25 located forward of a front end 16 of the insulator 11. The front end portion 25 is a portion of the base material 23. A fused portion 26 is formed at the front end of the front end portion 25, and a tip 27 is joined thereto. The fused portion 26 is a portion where the front end portion 25 and the tip 27 are fused together by, for example, resistance welding, laser beam welding, or electron beam welding. In this embodiment, the fused portion 26 is formed over the entire circumference of the front end portion 25 by laser beam welding.

The tip 27 is a member having a higher spark wear resistance than the base material 23 and formed of a noble metal such as Pt, Ir, Ru, or Rh or an alloy based thereon. In this embodiment, the tip 27 is a cylindrical member formed of an Ir-based alloy.

Although the abutting end faces of the tip 27 and the front end portion 25 illustrated in this embodiment remain in the center thereof, with the fused portion 26 formed therearound, they need not necessarily remain. The abutting end faces of the tip 27 and the front end portion 25 may completely fuse and disappear into the fused portion 26. The fused portion 26 alleviates the stress in the front end portion 25 and the tip 27 due to the difference in thermal expansion coefficient between the front end portion 25 and the tip 27.

Referring back to FIG. 1, the description is continued. A terminal stud 28 is a rod-like member for connection to a high-voltage cable (not shown) and is formed of a conductive metal material (e.g., low-carbon steel). The terminal stud 28 is secured to the rear end of the insulator 11 and has its front side disposed in the axial hole 12. The terminal stud 28 is electrically connected to the center electrode 20 in the axial hole 12.

A metal shell 30 is a cylindrical member disposed around the insulator 11. The metal shell 30 is formed of a conductive metal material (e.g., low-carbon steel). The metal shell 30 includes a trunk portion 31 surrounding a portion of the front side of the insulator 11, a seat portion 34 connecting to the rear side of the trunk portion 31, a tool engagement portion 35 connecting to the rear side of the seat portion 34, and a rear end portion 36 connecting to the rear side of the tool engagement portion 35. An external thread 32 is formed outside the trunk portion 31 for threaded engagement with a threaded hole of an engine (not shown). A stepped portion 33 is formed inside the trunk portion 31 to stop the stop portion 15 of the insulator 11 from the front side thereof.

The seat portion 34 is a portion for closing the gap between the external thread 32 and a threaded hole of an engine and has a larger outer diameter than the trunk portion 31. The tool engagement portion 35 is a portion with which a tool such as a wrench engages when the external thread 32 is screwed into a threaded hole of an engine. The rear end portion 36 is bent radially inward and is located rearward of the large-diameter portion 14 of the insulator 11. The metal shell 30 retains the large-diameter portion 14 and the stop portion 15 of the insulator 11 at the stepped portion 33 and the rear end portion 36.

The ground electrode 37 is a member formed of a metal (e.g., a nickel-based alloy) and connected to the trunk portion 31 of the metal shell 30. A spark gap is formed between the ground electrode 37 and the center electrode 20.

If the ground electrode 37 has joined thereto a tip formed of a noble metal or an alloy based thereon, as does the center electrode 20, the spark gap is formed between the tip of the ground electrode 37 and the tip 27 of the center electrode 20.

As shown in FIG. 2, an inner gasket 38 (another member different from the metal shell 30) is disposed between the stop portion 15 of the insulator 11 and the stepped portion 33 of the metal shell 30. The inner gasket 38 is an annular member formed of a metal and having a lower Young's modulus than the metal shell 30. The inner gasket 38 is held between the stop portion 15 and the stepped portion 33 so that heat moves from the insulator 11 and the center electrode 20 through the inner gasket 38 to the metal shell 30.

The spark plug 10 has a distance D of 22 mm or less in the direction along the axial line O from a first point 43 located at the frontmost position of a boundary 42 between an outer surface 40 of the front end portion 25 and an outer surface 41 of the fused portion 26 to a second point 45 located at the frontmost position of a contact area 44 between the inner gasket 38 and the stop portion 15. As the distance D becomes shorter, the heat rating of the spark plug 10 becomes higher, and heat escapes more easily from the front end portion 25 through the metal shell 30 to an engine (not shown). Thus, the front end portion 25 tends to undergo a larger temperature change when cooled by air-fuel mixture taken into the engine.

The front end portion 25 contains Ni, Cr, and at least one element selected from the group consisting of Mn, Si, Al, Ti, rare earth elements, Hf, and Zr (hereinafter referred to as "group B"). Examples of rare earth elements include Y, La, Ce, Nd, Sm, Dy, Er, and Yb. Of these elements, Ni is present in the front end portion 25 in the largest proportion, and Cr is present in the second largest proportion and in an amount of 12% by mass or more. Thus, an oxide film forms easily on the outer surface 40 of the front end portion 25, and the front end portion 25 (base material 23) also has sufficient workability. In addition, even if the oxide film peels off due to the difference in thermal expansion coefficient between the front end portion 25 and the oxide film as the front end portion 25 undergoes a temperature change due to the high heat rating of the spark plug 10, the oxide film forms easily again on the outer surface 40 of the front end portion 25. The oxide film on the front end portion 25 can inhibit further oxidation of the front end portion 25 and its corrosion due to sulfur remaining in fuel.

The front end portion 25 contains at least one element selected from the group B in a total amount of 0.1% by mass or more. Thus, a group B oxide or nitride film forms easily under the oxide film. As a result, even if the oxide film peels off, the group B oxide or nitride film can inhibit the oxidation of the front end portion 25 and its corrosion due to sulfur remaining in fuel.

Furthermore, the front end portion 25 satisfies $f/e \leq 0.15$ (including f=0 wt %) and $m/e \leq 0.015$ (including m=0 wt %), where f (wt %) is the Fe content, e (wt %) is the sum of the Cr, Si, and Al contents, and m (wt %) is the Mo content. Since Fe and Mo, which corrode easily, are present in smaller proportions than Cr, Si, and Al, sulfides such as those of Fe and Mo form less easily on the front end portion 25. Thus, the oxide film mainly formed by Cr on the front end portion 25 becomes dense and continuous. In addition, although chromium sulfide forms through the reaction of Cr with sulfur at a lower rate than other sulfides (e.g., FeS), a chromium sulfide layer on the front end portion 25 can inhibit the corrosion of the front end portion 25 due to sulfur. Thus, the wear resistance of the front end portion 25 can be improved.

The tip 27, which is joined to the front end portion 25 with the fused portion 26 therebetween, contains Ir in the largest proportion. Since the tip 27 contains a large amount of Ir, a large stress would tend to occur in the front end portion 25 due to the difference in thermal expansion coefficient between the tip 27 and the front end portion 25 despite the presence of the fused portion 26 between the tip 27 and the front end portion 25. Thus, the oxide film and the chromium sulfide layer on the front end portion 25 would tend to fracture. To alleviate the stress in the front end portion 25, the tip 27 contains at least one element selected from the group consisting of Pt, Ru, Rh, and Ni (hereinafter referred to as "group A") in an amount of 4% by mass or more. This can reduce the stress in the front end portion 25 due to the difference in thermal expansion coefficient between the front end portion 25 and the tip 27. As a result, the oxide film and the chromium sulfide layer on the front end portion 25 are less likely to fracture. Thus, the wear resistance of the front end portion 25 can be further improved.

Next, the structure of the front end portion 25 will be described with reference to the partial enlarged view in FIG. 2. As shown in FIG. 2, the front end portion 25 has a plurality of crystal grains 46 that appear in a cross-section containing the axial line O. The length (X) of the crystal grains 46 in the direction along the axial line O is longer than the length (Y) of the crystal grains 46 in the direction perpendicular to the axial line O. The lengths of the crystal grains 46 are measured in accordance with JIS G0551:2013. An example method for measuring the lengths (X and Y) of the crystal grains 46 will hereinafter be described.

The front end portion 25 having the tip 27 joined thereto (heat-affected during the formation of the fused portion 26) is cut into halves along a plane containing the axial line O (center line). One of the halves of the front end portion 25 is polished so that a flat cross-section appears, and a micrograph is obtained under a metallurgical microscope or by compositional imaging under a scanning electron microscope (SEM). If the crystal grains 46 are difficult to recognize, structural examination may be performed, for example, after electrolytic or electroless etching with an etchant, processing with a cross-section polisher (e.g., SM-09010 from JEOL Ltd.), or ion milling (e.g., IM-4000 from Hitachi High-Technologies Corporation), or by electron backscatter diffraction (EBSD).

Three straight test lines A parallel to the axial line O of the front end portion 25 are drawn on the resulting micrograph. The three test lines A are spaced apart from each other at intervals of 0.1 mm or more. The ends of the test lines A are separated from the fused portion 26 by a distance of 0.1 mm or more.

The numbers of crystal grains 46 through which the three test lines A pass or intercepted by the three test lines A ($N_1$, $N_2$, and $N_3$) are then counted. The crystal grains 46 are counted depending on the manner in which the test lines A intersect the crystal grains 46: $N_1$, $N_2$, $N_3$=1 if the test lines A pass through the crystal grains 46; $N_1$, $N_2$, $N_3$=0.5 if the test lines A terminate within the crystal grains 46; and $N_1$, $N_2$. $N_3$=0.5 if the test lines A abut the grain boundaries. The length (X) of the crystal grains 46 in the direction along the axial line O is defined as $(X_1+X_2+X_3)/(N_1+N_2+N_3)$, where $X_1$, $X_2$, and $X_3$ are the lengths of the segments of the test lines A intersecting the crystal grains 46.

Next, three straight test lines B perpendicular to the test lines A are drawn on the micrograph. The three test lines B are spaced apart from each other at intervals of 0.1 mm or more. The test line B that is closest to the fused portion 26 is separated from the fused portion 26 by a distance of 0.1 mm or more. The numbers of crystal grains 46 through which the three test lines B pass or intercepted by the three test lines B ($M_1$, $M_2$, and $M_3$) are then counted. The crystal grains 46 are counted depending on the manner in which the test lines B intersect the crystal grains 46: $M_1$, $M_2$, $M_3$=1 if the test lines B pass through the crystal grains 46; $M_1$, $M_2$, $M_3$=0.5 if the test lines B terminate within the crystal grains 46; and $M_1$, $M_2$, $M_3$=0.5 if the test lines B about the grain boundaries. The length (Y) of the crystal grains 46 in the direction perpendicular to the axial line O is defined as $(Y_1+Y_2+Y_3)/(M_1+M_2+M_3)$, where $Y_1$, $Y_2$, and $Y_3$ are the lengths of the segments of the test lines B intersecting the crystal grains 46.

The structure of the front end portion 25 is set to satisfy Ha/Hb≥0.36, where Ha is the Vickers hardness of the front end portion 25 in the cross-section after heat treatment at 900° C. in an Ar atmosphere for 50 hours, and Hb is the Vickers hardness of the front end portion 25 in the cross-section before the heat treatment. The structure and hardness of the front end portion 25 can be controlled by changing, for example, the composition of the front end portion 25, the welding method, the atmosphere during welding, the irradiation conditions for the laser beam or electron beam used for welding, the material, shape, and other properties of the front end portion 25 (the length and cross-sectional area of the front end portion 25 in the direction along the axial line O), and the processing conditions during the manufacture of the center electrode 20.

The Vickers hardness of the front end portion 25 is measured in accordance with JIS Z2244 (2009). The cut surface of the front end portion 25 used for the measurement of the lengths (X and Y) of the crystal grains 46 is mirror-polished for use as a test specimen for the measurement of the Vickers hardness Hb. The cut surface of the other half of the front end portion 25 cut along a plane containing the axial line O is mirror-polished for use as a test specimen for the measurement of the Vickers hardness Ha.

If two test specimens cannot be prepared by cutting the front end portion 25, two spark plugs 10 manufactured under the same conditions may be provided instead. One of the spark plugs 10 may be used to prepare a test specimen for the measurement of the Vickers hardness Hb, whereas the other spark plug 10 may be used to prepare a test specimen for the measurement of the Vickers hardness Ha.

The test specimen for the measurement of the Vickers hardness Ha is subjected to heat treatment before the cut surface is mirror-polished. The heat treatment is performed by placing the front end portion 25 that has been heat-affected during the formation of the fused portion 26 (which may include the tip 27 and the fused portion 26) in an atmosphere furnace, heating the front end portion 25 to 900° C. at a rate of 10° C./min while supplying Ar at a flow rate of 2 L/min, maintaining heating at 900° C. for 50 hours, and stopping heating and allowing the front end portion 25 to cool while supplying Ar at a flow rate of 2 L/min. The heat treatment is intended to remove any residual stress from the front end portion 25 and to adjust the crystal structure of the front end portion 25, which has changed due to the influence of processing and other factors such as welding heat.

The points where the Vickers hardnesses Ha and Hb are measured (the points where an indenter is pressed) may be located at any position within the region of the front end portion 25 where the test lines B are drawn. These measurement points, however, are separated from the outer surface 40 of the front end portion 25 by a distance of 0.1 mm or more. Four measurement points are selected such that indentations formed by pressing an indenter are separated from each other by a distance of 0.4 mm or more. If an indentation is present in the fused portion 26 or in a region within 0.1 mm from the boundary between the fused portion 26 and the front end portion 25, that indentation is excluded from the measurements to avoid the influence of the fused portion 26 on the measurements. The test force applied to the indenter is 4.9 N. The test force is held for 10 seconds. The Vickers hardnesses Ha and Hb are calculated as the arithmetic mean of the measurements at the four measurement points.

If the ratio of the thus-measured Vickers hardnesses Ha and Hb before and after the heat treatment satisfies Ha/Hb≥0.36, the recrystallization and grain growth of the crystal grains 46 at high temperature can be inhibited. As a result, the structure of the front end portion 25 in which the length (X) of the crystal grains 46 in the direction along the axial line O is longer than the length (Y) of the crystal grains 46 in the direction perpendicular to the axial line O (X>Y) can be maintained at high temperature. Accordingly, the corrosion length of the grain boundaries required for the front end portion 25 to fracture as intergranular corrosion proceeds in the direction perpendicular to the axial line O is longer than if X≤Y. Thus, the likelihood of the front end portion 25 fracturing or the tip 27 coming off due to intergranular corrosion at high temperature can be reduced.

In particular, if the length (X) of the crystal grains 46 in the direction along the axial line O is 1.5 times or more the length (Y) of the crystal grains 46 in the direction perpendicular to the axial line O, the corrosion length of the grain boundaries required for the front end portion 25 to fracture due to intergranular corrosion is even longer. Thus, the effect of reducing the likelihood of the front end portion 25 fracturing or the tip 27 coming off due to intergranular corrosion at high temperature can be improved.

Since the recrystallization and grain growth of the crystal grains 46 at high temperature can be inhibited if Ha/Hb≥0.36, the resulting change in the shape of the front end portion 25 (strain recovery) can also be inhibited. As a result, the likelihood of a fracture occurring in the oxide film on the surface of the front end portion 25 can be reduced. Thus, the oxide film can inhibit the contact of sulfur with the front end portion 25 and can therefore inhibit the corrosion of the front end portion 25 due to sulfur.

EXAMPLES

The following examples are given to describe the present invention in more detail, although these examples are not intended to limit the scope of the invention.

Example 1

Preparation of Samples 1 to 51

The tester provided various base materials 23 of the same size and various cylindrical tips 27 of the same size. After the end faces of the base materials 23 and the tips 27 were brought into abutment with each other, the boundaries between the base materials 23 and the tips 27 were irradiated over the entire periphery thereof with a laser beam from a fiber laser beam welding machine to form fused portions 26 and thereby obtain various center electrodes 20. The energy input to the base materials 23 and the tips 27 by the fiber laser beam welding machine was adjusted so that the lengths from the boundaries between the outer surfaces 41 of the fused portions 26 and the tips 27 to the front ends of the tips 27 in the direction along the axial line O were identical even though the tips 27 had different compositions.

The resulting various center electrodes 20 were fixed to insulators 11, and the insulators 11 were equipped with metal shells 30 to obtain spark plugs 10 of Samples 1 to 51. A plurality of samples prepared under the same conditions were provided for each type of sample since a plurality of evaluations were performed for each type of sample.

TABLE 1

| | Tip (wt %) | | | | | Front end portion of center electrode (wt %) | | | | | | | | | | | | |
|---|---|---|---|---|---|---|---|---|---|---|---|---|---|---|---|---|---|---|
| | | Group A | | | | | | Group B | | | | | | | | | | |
| No. | Ir | Rh | Pt | Ru | Ni | Ni | Cr | Mn | Al | Si | Ti | Y | Hf | Zr | La | Fe | Mo | C |
| 1 | 80.0 | 8.0 | 0 | 11.0 | 1.0 | 60.40 | 23.0 | 0.8 | 1.35 | 0.2 | 0.20 | 0 | 0 | 0 | 0 | 14.00 | 0.01 | 0.04 |
| 2 | 80.0 | 8.0 | 0 | 11.0 | 1.0 | 75.75 | 15.0 | 0.8 | 0 | 0.2 | 0.20 | 0 | 0 | 0 | 0 | 8.00 | 0.01 | 0.04 |
| 3 | 80.0 | 8.0 | 0 | 11.0 | 1.0 | 63.35 | 25.0 | 0.8 | 2.30 | 0.2 | 0.20 | 0.1 | 0 | 0 | 0 | 8.00 | 0.01 | 0.04 |
| 4 | 80.0 | 8.0 | 0 | 11.0 | 1.0 | 94.75 | 2.0 | 2.3 | 0 | 0.5 | 0.30 | 0 | 0 | 0 | 0 | 0.10 | 0.01 | 0.04 |
| 5 | 80.0 | 8.0 | 0 | 11.0 | 1.0 | 87.15 | 10.0 | 0.8 | 1.10 | 0.9 | 0 | 0 | 0 | 0 | 0 | 0 | 0.01 | 0.04 |
| 6 | 80.0 | 8.0 | 0 | 11.0 | 1.0 | 84.15 | 12.0 | 0.8 | 1.10 | 0.9 | 0 | 0 | 0 | 0 | 0 | 1.00 | 0.01 | 0.04 |
| 7 | 80.0 | 8.0 | 0 | 11.0 | 1.0 | 77.15 | 20.0 | 0.8 | 1.10 | 0.9 | 0 | 0 | 0 | 0 | 0 | 0 | 0.01 | 0.04 |
| 8 | 85.0 | 3.0 | 0 | 11.0 | 1.0 | 77.12 | 20.0 | 0.8 | 1.10 | 0.9 | 0 | 0 | 0 | 0 | 0 | 0.03 | 0.01 | 0.04 |
| 9 | 80.0 | 8.0 | 0 | 11.0 | 1.0 | 77.11 | 20.0 | 0.8 | 1.10 | 0.9 | 0 | 0 | 0 | 0 | 0 | 0.04 | 0.01 | 0.04 |
| 10 | 53.0 | 35.0 | 0 | 11.0 | 1.0 | 72.16 | 25.0 | 0.8 | 1.10 | 0.9 | 0 | 0 | 0 | 0 | 0 | 0 | 0 | 0.04 |
| 11 | 80.0 | 8.0 | 0 | 11.0 | 1.0 | 72.16 | 25.0 | 0.8 | 1.10 | 0.9 | 0 | 0 | 0 | 0 | 0 | 0 | 0 | 0.04 |
| 12 | 80.0 | 8.0 | 0 | 11.0 | 1.0 | 72.16 | 25.0 | 0.8 | 1.10 | 0.9 | 0 | 0 | 0 | 0 | 0 | 0 | 0 | 0.04 |
| 13 | 80.0 | 8.0 | 0 | 11.0 | 1.0 | 72.16 | 25.0 | 0.8 | 1.10 | 0.9 | 0 | 0 | 0 | 0 | 0 | 0 | 0 | 0.04 |
| 14 | 80.0 | 8.0 | 0 | 11.0 | 1.0 | 72.16 | 25.0 | 0.8 | 1.10 | 0.9 | 0 | 0 | 0 | 0 | 0 | 0 | 0 | 0.04 |
| 15 | 80.0 | 8.0 | 0 | 11.0 | 1.0 | 67.15 | 30.0 | 0.8 | 1.10 | 0.9 | 0 | 0 | 0 | 0 | 0 | 0 | 0.01 | 0.04 |
| 16 | 97.0 | 2.0 | 0 | 0 | 1.0 | 67.15 | 30.0 | 0.8 | 1.10 | 0.9 | 0 | 0 | 0 | 0 | 0 | 0 | 0.01 | 0.04 |
| 17 | 80.0 | 8.0 | 0 | 11.0 | 1.0 | 57.70 | 40.0 | 0.1 | 1.10 | 0.9 | 0.15 | 0 | 0 | 0 | 0 | 0 | 0.01 | 0.04 |
| 18 | 80.0 | 8.0 | 0 | 11.0 | 1.0 | 72.05 | 25.0 | 0.8 | 1.10 | 0.9 | 0 | 0 | 0 | 0 | 0 | 0.10 | 0.01 | 0.04 |
| 19 | 80.0 | 8.0 | 0 | 11.0 | 1.0 | 71.38 | 25.0 | 0.8 | 1.10 | 0.6 | 0 | 0 | 0 | 0 | 0 | 1.07 | 0.01 | 0.04 |
| 20 | 80.5 | 8.0 | 0 | 11.0 | 0.5 | 68.95 | 25.0 | 0.8 | 1.10 | 0.9 | 0.20 | 0 | 0 | 0 | 0 | 3.00 | 0.01 | 0.04 |
| 21 | 80.0 | 8.0 | 0 | 11.0 | 1.0 | 68.10 | 25.0 | 0.8 | 1.10 | 0.9 | 0 | 0 | 0 | 0 | 0 | 4.05 | 0.01 | 0.04 |
| 22 | 86.0 | 8.0 | 0 | 5.0 | 1.0 | 67.15 | 25.0 | 0.8 | 1.10 | 0.9 | 0 | 0 | 0 | 0 | 0 | 5.00 | 0.01 | 0.04 |
| 23 | 80.0 | 8.0 | 0 | 11.0 | 1.0 | 71.46 | 25.0 | 0.8 | 1.10 | 0.9 | 0 | 0 | 0 | 0 | 0 | 0 | 0.70 | 0.04 |
| 24 | 80.0 | 8.0 | 0 | 11.0 | 1.0 | 71.75 | 25.0 | 0.8 | 1.10 | 0.9 | 0 | 0 | 0 | 0 | 0 | 0 | 0.41 | 0.04 |
| 25 | 57.0 | 31.0 | 0 | 11.0 | 1.0 | 71.91 | 25.0 | 0.8 | 1.10 | 0.9 | 0 | 0 | 0 | 0 | 0 | 0 | 0.25 | 0.04 |
| 26 | 80.0 | 8.0 | 0 | 11.0 | 1.0 | 71.35 | 25.0 | 1.5 | 1.10 | 0.9 | 0 | 0 | 0 | 0 | 0 | 0 | 0.11 | 0.04 |
| 27 | 80.0 | 8.0 | 0 | 11.0 | 1.0 | 71.21 | 25.0 | 0.8 | 2.00 | 0.9 | 0 | 0 | 0 | 0 | 0 | 0 | 0.05 | 0.04 |
| 28 | 80.0 | 8.0 | 0 | 11.0 | 1.0 | 72.16 | 25.0 | 0.8 | 1.10 | 0.9 | 0 | 0 | 0 | 0 | 0 | 0 | 0 | 0.04 |
| 29 | 80.0 | 8.0 | 0 | 11.0 | 1.0 | 76.61 | 20.0 | 0 | 1.10 | 0 | 0 | 0 | 0 | 0 | 0 | 2.00 | 0.25 | 0.04 |
| 30 | 80.0 | 8.0 | 0 | 11.0 | 1.0 | 76.09 | 20.0 | 0 | 1.10 | 0.9 | 0 | 0 | 0 | 0 | 0 | 1.70 | 0.17 | 0.04 |
| 31 | 80.0 | 8.0 | 0 | 11.0 | 1.0 | 73.52 | 20.0 | 0.8 | 1.10 | 0.9 | 0 | 0 | 0 | 0 | 0 | 3.30 | 0.34 | 0.04 |
| 32 | 80.0 | 8.0 | 0 | 11.0 | 1.0 | 80.61 | 15.0 | 0 | 0 | 1.5 | 0 | 0 | 0 | 0 | 0 | 2.60 | 0.25 | 0.04 |
| 33 | 68.0 | 20.0 | 0 | 11.0 | 1.0 | 81.31 | 15.0 | 0 | 1.10 | 0.9 | 0 | 0 | 0 | 0 | 0 | 1.50 | 0.15 | 0.04 |
| 34 | 80.0 | 8.0 | 0 | 11.0 | 1.0 | 81.61 | 15.0 | 0.8 | 0 | 0.9 | 0 | 0 | 0 | 0 | 0 | 1.50 | 0.15 | 0.04 |
| 35 | 80.0 | 8.0 | 0 | 11.0 | 1.0 | 82.21 | 15.0 | 0 | 1.10 | 0 | 0 | 0 | 0 | 0 | 0 | 1.50 | 0.15 | 0.04 |
| 36 | 81.0 | 8.0 | 0 | 11.0 | 0 | 81.51 | 15.0 | 0.8 | 0.50 | 0.5 | 0 | 0 | 0 | 0 | 0 | 1.50 | 0.15 | 0.04 |
| 37 | 80.0 | 8.0 | 0 | 11.0 | 1.0 | 83.21 | 15.0 | 0 | 0 | 0 | 0 | 0.1 | 0 | 0 | 0 | 1.50 | 0.15 | 0.04 |
| 38 | 64.0 | 20.0 | 0 | 15.0 | 1.0 | 80.41 | 15.0 | 0.8 | 1.10 | 0.9 | 0 | 0 | 0.1 | 0 | 0 | 1.50 | 0.15 | 0.04 |
| 39 | 80.0 | 8.0 | 0 | 11.0 | 1.0 | 82.41 | 15.0 | 0.8 | 0 | 0 | 0 | 0 | 0 | 0.1 | 0 | 1.50 | 0.15 | 0.04 |
| 40 | 80.0 | 8.0 | 0 | 11.0 | 1.0 | 80.41 | 15.0 | 0.8 | 1.10 | 0.9 | 0 | 0 | 0 | 0 | 0.1 | 1.50 | 0.15 | 0.04 |
| 41 | 80.0 | 8.0 | 0 | 11.0 | 1.0 | 83.21 | 15.0 | 0 | 0 | 0 | 0 | 0 | 0 | 0 | 0.1 | 1.50 | 0.15 | 0.04 |
| 42 | 97.0 | 2.0 | 0 | 0 | 1.0 | 81.31 | 15.0 | 0 | 1.10 | 0.9 | 0 | 0 | 0 | 0 | 0 | 1.50 | 0.15 | 0.04 |
| 43 | 97.0 | 2.0 | 0 | 0 | 1.0 | 81.31 | 15.0 | 0 | 1.10 | 0.9 | 0 | 0 | 0 | 0 | 0 | 1.50 | 0.15 | 0.04 |
| 44 | 97.0 | 2.0 | 0 | 0 | 1.0 | 83.31 | 15.0 | 0 | 0 | 0 | 0 | 0 | 0 | 0 | 0 | 1.50 | 0.15 | 0.04 |
| 45 | 97.0 | 2.0 | 0 | 0 | 1.0 | 73.31 | 25.0 | 0 | 0 | 0 | 0 | 0 | 0 | 0 | 0 | 1.50 | 0.15 | 0.04 |
| 46 | 96.0 | 4.0 | 0 | 0 | 0 | 81.31 | 15.0 | 0 | 1.10 | 0.9 | 0 | 0 | 0 | 0 | 0 | 1.50 | 0.15 | 0.04 |
| 47 | 92.0 | 8.0 | 0 | 0 | 0 | 81.31 | 15.0 | 0 | 1.10 | 0.9 | 0 | 0 | 0 | 0 | 0 | 1.50 | 0.15 | 0.04 |
| 48 | 98.0 | 0 | 2.0 | 0 | 0 | 81.31 | 15.0 | 0 | 1.10 | 0.9 | 0 | 0 | 0 | 0 | 0 | 1.50 | 0.15 | 0.04 |
| 49 | 98.0 | 0 | 2.0 | 0 | 0 | 81.31 | 15.0 | 0 | 1.10 | 0.9 | 0 | 0 | 0 | 0 | 0 | 1.50 | 0.15 | 0.04 |
| 50 | 96.0 | 0 | 4.0 | 0 | 0 | 81.31 | 15.0 | 0 | 1.10 | 0.9 | 0 | 0 | 0 | 0 | 0 | 1.50 | 0.15 | 0.04 |
| 51 | 96.0 | 0 | 2.0 | 2.0 | 0 | 81.31 | 15.0 | 0 | 1.10 | 0.9 | 0 | 0 | 0 | 0 | 0 | 1.50 | 0.15 | 0.04 |

Table 1 lists the compositions of the base materials 23 (front end portions 25) of the center electrodes 20 and the compositions of the tips 27 of the spark plugs 10 of Samples 1 to 51.

The compositions of the base materials 23 of the center electrodes 20 were measured by inductively-coupled-plasma (ICP) emission spectroscopy using specimens of the base materials 23 cut from the front end portions 25 forward of the front ends 16 of the insulators 11. When it was impossible to obtain specimens required for analysis from one front end portion 25, specimens obtained from a plurality of front end portions 25 were collected and used for analysis. Elements with a value of 0 (zero) in Table 1 were present in an amount below the detection limit, that is, essentially absent. The compositional analysis of the front end portions 25 may also be performed with, for example, an atomic absorption spectrometer or a wavelength-dispersive X-ray spectrometer (WDS).

The mass compositions of the tips 27 were measured by WDS analysis (acceleration voltage: 20 kV, spot diameter of measurement region: 100 μm) with an electron probe micro-analyzer (EPMA) (JXA-8500F from JEOL Ltd.). The tips 27 were cut along a plane containing the axial line O, and the arithmetic mean of measurements at five measurement points in the cut surface was calculated. Elements with a value of 0 (zero) in Table 1 were present in an amount below the detection limit. When the measurement region at any measurement point was included in the fused portion 26, with the spot size taken into account, the result obtained at that measurement point was excluded, which is intended to prevent a decrease in the accuracy of compositional analysis.

The tester obtained an image of the portion of each spark plug 10 forward of the inner gasket 38 with an X-ray fluoroscope to acquire information about the size of the outer surface 40 of the front end portion 25 and the distance D in advance before the corrosion test described below.

Corrosion Test

The tester attached each sample spark plug to an engine, started the engine using a gasoline containing 5 ppm of sulfur as a fuel, and subjected the sample to 3,000 cycles of operation, each cycle including full-throttle operation for 1 minute and idling operation for 1 minute. During the full-throttle operation, the temperature of the portion of the center electrode 20 located 1 mm rearward of the front end of the tip 27 reached 850° C.

Wear Resistance Rating of Front End Portion

The tester detached the sample from the engine after the corrosion test, cut the front end portion 25 along a plane containing the axial line O, examined the cut surface under a microscope, and measured the maximum thickness T (the size in the direction perpendicular to the axial line O) over which the front end portion 25 was corroded by testing from the outer surface 40 of the front end portion 25 based on the size of the outer surface 40 acquired in advance. In the measurement of the thickness T, the boundary between the fused portion 26 and the front end portion 25 was regarded as part of the front end portion 25. When the corroded area was unclear in the microscopy, the thickness T was measured by identifying the position of sulfur entering the front end portion 25 with an EPMA.

Rating was made based on the thickness T (maximum thickness) on a scale of seven from A to G. The rating scale is as follows:

A: T<100 μm
B: 100 μm≤T<150 μm
C: 150 μm≤T<200 μm
D: 200 μm≤T<350 μm
E: 350 μm≤T<500 μm
F: T≥500 μm, but the tip did not come off.
G: The tip came off.

TABLE 2

| No. | Group A (wt %) | Group B (wt %) | f (wt %) | m (wt %) | e (wt %) | f/e | m/e | Ha/Hb | Crystal grain | D (mm) | Rating |
|---|---|---|---|---|---|---|---|---|---|---|---|
| 1 | 20.0 | 2.6 | 14.00 | 0.01 | 24.55 | 0.570 | 0.000 | 0.45 | F | 22 | G |
| 2 | 20.0 | 1.2 | 8.00 | 0.01 | 15.20 | 0.526 | 0.001 | 0.45 | F | 22 | G |
| 3 | 20.0 | 3.6 | 8.00 | 0.01 | 27.50 | 0.291 | 0.000 | 0.45 | F | 22 | G |
| 4 | 20.0 | 3.1 | 0.10 | 0.01 | 2.50 | 0.040 | 0.004 | 0.45 | F | 22 | G |
| 5 | 20.0 | 2.8 | 0.00 | 0.01 | 12.00 | 0 | 0.001 | 0.45 | F | 22 | G |
| 6 | 20.0 | 2.8 | 1.00 | 0.01 | 14.00 | 0.071 | 0.001 | 0.35 | F | 22 | D |
| 7 | 20.0 | 2.8 | 0.00 | 0.01 | 22.00 | 0 | 0.000 | 0.55 | F | 22 | A |
| 8 | 15.0 | 2.8 | 0.03 | 0.01 | 22.00 | 0.001 | 0.000 | 0.55 | F | 22 | A |
| 9 | 20.0 | 2.8 | 0.04 | 0.01 | 22.00 | 0.002 | 0.000 | 0.55 | F | 22 | B |
| 10 | 47.0 | 2.8 | 0.00 | 0.00 | 27.00 | 0 | 0 | 1.00 | N | 22 | B |
| 11 | 20.0 | 2.8 | 0.00 | 0.00 | 27.00 | 0 | 0 | 1.00 | F | 21 | A |
| 12 | 20.0 | 2.8 | 0.00 | 0.00 | 27.00 | 0 | 0 | 0.90 | F | 22 | A |
| 13 | 20.0 | 2.8 | 0.00 | 0.00 | 27.00 | 0 | 0 | 0.45 | F | 20 | A |
| 14 | 20.0 | 2.8 | 0.00 | 0.00 | 27.00 | 0 | 0 | 0.35 | F | 22 | B |
| 15 | 20.0 | 2.8 | 0.00 | 0.01 | 32.00 | 0 | 0.000 | 0.55 | F | 19 | A |
| 16 | 3.0 | 2.8 | 0.00 | 0.01 | 32.00 | 0 | 0.000 | 0.55 | F | 22 | B |
| 17 | 20.0 | 2.3 | 0.00 | 0.01 | 42.00 | 0 | 0.000 | 0.49 | F | 22 | A |
| 18 | 20.0 | 2.8 | 0.10 | 0.01 | 27.00 | 0.004 | 0.000 | 0.45 | F | 22 | B |
| 19 | 20.0 | 2.5 | 1.07 | 0.01 | 26.70 | 0.040 | 0.000 | 0.45 | F | 22 | B |
| 20 | 19.5 | 3.0 | 3.00 | 0.01 | 27.00 | 0.111 | 0.000 | 0.52 | F | 22 | C |
| 21 | 20.0 | 2.8 | 4.05 | 0.01 | 27.00 | 0.150 | 0.000 | 0.49 | F | 22 | C |
| 22 | 14.0 | 2.8 | 5.00 | 0.01 | 27.00 | 0.185 | 0.000 | 0.47 | F | 22 | G |
| 23 | 20.0 | 2.8 | 0.00 | 0.70 | 27.00 | 0 | 0.026 | 0.45 | F | 22 | G |
| 24 | 20.0 | 2.8 | 0.00 | 0.41 | 27.00 | 0 | 0.015 | 0.45 | F | 22 | B |
| 25 | 43.0 | 2.8 | 0.00 | 0.25 | 27.00 | 0 | 0.009 | 0.45 | F | 21 | B |
| 26 | 20.0 | 3.5 | 0.00 | 0.11 | 27.00 | 0 | 0.004 | 0.45 | F | 22 | A |
| 27 | 20.0 | 3.7 | 0.00 | 0.05 | 27.90 | 0 | 0.002 | 0.45 | F | 22 | A |
| 28 | 20.0 | 2.8 | 0.00 | 0.00 | 27.00 | 0 | 0 | 0.45 | F | 22 | A |
| 29 | 20.0 | 1.1 | 2.00 | 0.25 | 21.10 | 0.095 | 0.012 | 0.45 | F | 22 | D |
| 30 | 20.0 | 2.0 | 1.70 | 0.17 | 22.00 | 0.077 | 0.008 | 0.45 | F | 22 | D |
| 31 | 20.0 | 2.8 | 3.30 | 0.34 | 22.00 | 0.150 | 0.015 | 0.45 | F | 22 | D |
| 32 | 20.0 | 1.5 | 2.60 | 0.25 | 16.50 | 0.158 | 0.015 | 0.49 | F | 22 | D |
| 33 | 32.0 | 2.0 | 1.50 | 0.15 | 17.00 | 0.088 | 0.009 | 0.49 | F | 22 | D |
| 34 | 20.0 | 1.7 | 1.50 | 0.15 | 15.90 | 0.094 | 0.009 | 0.49 | F | 21 | D |
| 35 | 20.0 | 1.1 | 1.50 | 0.15 | 16.10 | 0.093 | 0.009 | 0.49 | F | 22 | D |
| 36 | 19.0 | 1.8 | 1.50 | 0.15 | 16.00 | 0.094 | 0.009 | 0.49 | F | 20 | D |
| 37 | 20.0 | 0.1 | 1.50 | 0.15 | 15.00 | 0.100 | 0.010 | 0.49 | F | 22 | D |
| 38 | 36.0 | 2.9 | 1.50 | 0.15 | 17.00 | 0.088 | 0.009 | 0.49 | F | 22 | D |
| 39 | 20.0 | 0.9 | 1.50 | 0.15 | 15.00 | 0.100 | 0.010 | 0.49 | F | 19 | D |
| 40 | 20.0 | 2.0 | 1.50 | 0.15 | 17.00 | 0.088 | 0.009 | 0.49 | F | 22 | D |
| 41 | 20.0 | 0.1 | 1.50 | 0.15 | 15.00 | 0.100 | 0.010 | 0.49 | F | 22 | D |
| 42 | 3.0 | 2.0 | 1.50 | 0.15 | 17.00 | 0.088 | 0.009 | 0.35 | F | 22 | F |
| 43 | 3.0 | 2.0 | 1.50 | 0.15 | 17.00 | 0.088 | 0.009 | 0.36 | F | 22 | E |
| 44 | 3.0 | 0.0 | 1.50 | 0.15 | 15.00 | 0.100 | 0.010 | 0.35 | F | 22 | G |
| 45 | 3.0 | 0.0 | 1.50 | 0.15 | 25.00 | 0.060 | 0.006 | 0.35 | F | 22 | G |
| 46 | 4.0 | 2.0 | 1.50 | 0.15 | 17.00 | 0.088 | 0.009 | 0.35 | F | 20 | E |
| 47 | 8.0 | 2.0 | 1.50 | 0.15 | 17.00 | 0.088 | 0.009 | 0.35 | F | 22 | E |
| 48 | 2.0 | 2.0 | 1.50 | 0.15 | 17.00 | 0.088 | 0.009 | 0.35 | F | 22 | F |
| 49 | 2.0 | 2.0 | 1.50 | 0.15 | 17.00 | 0.088 | 0.009 | 0.36 | F | 22 | E |

TABLE 2-continued

| No. | Group A (wt %) | Group B (wt %) | f (wt %) | m (wt %) | e (wt %) | f/e | m/e | Ha/Hb | Crystal grain | D (mm) | Rating |
|---|---|---|---|---|---|---|---|---|---|---|---|
| 50 | 4.0 | 2.0 | 1.50 | 0.15 | 17.00 | 0.088 | 0.009 | 0.35 | F | 22 | E |
| 51 | 4.0 | 2.0 | 1.50 | 0.15 | 17.00 | 0.088 | 0.009 | 0.35 | F | 22 | E |

Table 2 lists the group A contents, the group B contents, the contents f, m, and e, the ratios f/e and m/e, the Vickers hardness ratios Ha/Hb, the information about the length of the crystal grains, the distances D, and the wear-resistance ratings of the spark plugs of Samples 1 to 51.

In Table 2, f is the Fe content of the front end portion, m is the Mo content of the front end portion, and e is the sum of the Cr, Si, and Al contents of the front end portion. The values of f/e and m/e were rounded to three decimal places. In the "crystal grain" column of Table 2, "F" (Samples 1 to 9 and 11 to 51) means that the length (X) of the crystal grains 46 in the direction along the axial line O was longer than the length (Y) of the crystal grains 46 in the direction perpendicular to the axial line O (X>Y), whereas "N" (Sample 10) means that Y was longer than X (X<Y). For Samples 1 to 9 and 11 to 51, X/Y>1.5. For Samples 1 to 51, Ni was present in the front end portion in the largest proportion.

As shown in Table 2, Samples 7, 8, 11 to 13, 15, 17, and 26 to 28 were rated as A. For these samples rated as A. Cr was present in the front end portion in the second largest proportion and in an amount of 12% by mass or more, the group B was present in a proportion of 0.1% by mass or more, and the front end portion satisfied f/e≤0.001 and m/e≤0.004. As for the crystal grains in the front end portion, X>Y, and Ha/Hb≥0.36. The group A was present in the tip in a proportion of 4% by mass or more. The corrosion of the front end portions 25 of the samples rated as A due to sulfur was probably inhibited by chromium sulfide and oxide film.

For Samples 7, 8, 12, 17, and 26 to 28, D=22 mm. For Sample 11, D=21 mm. For Sample 13, D=20 mm. For Sample 15, D=19 mm. Samples 7, 8, 11 to 13, 15, 17, and 26 to 28, in which D=19 to 22 mm, were found to be rated as A.

Samples 9, 10, 14, 16, 18, 19, 24, and 25 were rated as B. For Samples 9, 18, and 19, Cr was present in the front end portion in the second largest proportion and in an amount of 12% by mass or more, the group B was present in a proportion of 0.1% by mass or more, and the front end portion satisfied f/e≤0.04 and m/e≤0.004. As for the crystal grains in the front end portion, X>Y, and Ha/Hb≥0.36. The group A was present in the tip in a proportion of 4% by mass or more. These samples corroded faster than the samples rated as A probably because they had larger values of f/e than the samples rated as A.

For Samples 24 and 25, Cr was present in the front end portion in the second largest proportion and in an amount of 12% by mass or more, the group B was present in a proportion of 0.1% by mass or more, and the front end portion satisfied f/e≤0.001 and m/e≤0.015. As for the crystal grains in the front end portion, X>Y, and Ha/Hb≥0.36. The group A was present in the tip in a proportion of 4% by mass or more. These samples corroded faster than the samples rated as A probably because they had larger values of m/e than the samples rated as A.

For Sample 10, Cr was present in the front end portion in the second largest proportion and in an amount of 12% by mass or more, the group B was present in a proportion of 0.1% by mass or more, and the front end portion satisfied f/e≤0.001 and m/e≤0.004. Ha/Hb≥0.36, and the group A was present in the tip in a proportion of 4% by mass or more. However, as for the crystal grains in the front end portion, X<Y, which is probably the reason why this sample underwent intergranular corrosion faster than the samples rated as A.

For Sample 14, Cr was present in the front end portion in the second largest proportion and in an amount of 12% by mass or more, the group B was present in a proportion of 0.1% by mass or more, and the front end portion satisfied f/e≤0.001 and m/e≤0.004. As for the crystal grains in the front end portion, X>Y, and the group A was present in the tip in a proportion of 4% by mass or more. However, Ha/Hb<0.36. Thus, this sample corroded faster than the samples rated as A probably because phenomena such as grain growth occurred during the corrosion test.

For Sample 16, Cr was present in the front end portion in the second largest proportion and in an amount of 12% by mass or more, the group B was present in a proportion of 0.1% by mass or more, and the front end portion satisfied f/e≤0.001 and m/e≤0.004. As for the crystal grains in the front end portion, X>Y, and Ha/Hb≤0.36. However, the group A was present in the tip in a proportion of less than 4% by mass. Thus, this sample corroded faster than the samples rated as A probably because the oxide film peeled off more easily due to the stress in the front end portion during the corrosion test.

Samples 20 and 21 were rated as C. For these samples, Cr was present in the front end portion in the second largest proportion and in an amount of 12% by mass or more, the group B was present in a proportion of 0.1% by mass or more, and the front end portion satisfied f/e≤0.15 and m/e≤0.004. As for the crystal grains in the front end portion, X>Y, and Ha/Hb≥0.36. The group A was present in the tip in a proportion of 4% by mass or more. However, these samples corroded faster than the samples rated as B probably because they had larger values of f/e than the samples rated as B.

Samples 6 and 29 to 41 were rated as D. For Sample 6, Cr was present in the front end portion in the second largest proportion and in an amount of 12% by mass or more, the group B was present in a proportion of 0.1% by mass or more, and the front end portion satisfied f/e≤0.15 and m/e≤0.004. As for the crystal grains in the front end portion, X>Y, and the group A was present in the tip in a proportion of 4% by mass or more. However, Ha/Hb<0.36. Thus, this sample corroded faster than the samples rated as C probably because phenomena such as grain growth occurred and thus resulted in the peeling of the oxide film and intergranular corrosion during the corrosion test.

For Samples 29 to 31 and 33 to 41, Cr was present in the front end portion in the second largest proportion and in an amount of 12% by mass or more, the group B was present in a proportion of 0.1% by mass or more, and the front end portion satisfied f/e≤0.15 and m/e≤0.015. As for the crystal grains in the front end portion, X>Y, and Ha/Hb≥0.36. The group A was present in the tip in a proportion of 4% by mass or more. However, these samples corroded faster than the samples rated as C probably because they had larger values of m/e than the samples rated as C. Although Samples 33 to 41 contained different group B elements in different proportions (although they were present in a proportion of 0.1% by mass or more), their corrosion ratings were identical.

For Sample 32, Cr was present in the front end portion in the second largest proportion and in an amount of 12% by mass or more, the group B was present in a proportion of 0.1% by mass or more, and the front end portion satisfied m/e≤0.015. As for the crystal grains in the front end portion, X>Y, and Ha/Hb≥0.36. The group A was present in the tip in a proportion of 4% by mass or more. However, f/e≥0.15, which is probably the reason why this sample corroded faster than the samples rated as C.

For Samples 43, 46, 47, and 49 to 51 were rated as E. For Samples 43 and 49, Cr was present in the front end portion in the second largest proportion and in an amount of 12% by mass or more, the group B was present in a proportion of 0.1% by mass or more, and the front end portion satisfied f/e≤0.15 and m/e≤0.015. As for the crystal grains in the front end portion, X>Y, and Ha/Hb≥0.36. However, the group A was present in the tip in a proportion of less than 4% by mass. Thus, these samples corroded faster than the samples rated as D probably because the oxide film peeled off more easily due to the stress in the front end portion during the corrosion test.

For Samples 46, 47, 50, and 51, Cr was present in the front end portion in the second largest proportion and in an amount of 12% by mass or more, the group B was present in a proportion of 0.1% by mass or more, and the front end portion satisfied f/e≤0.15 and m/e≤0.015. As for the crystal grains in the front end portion, X>Y, and the group A was present in the tip in a proportion of 4% by mass or more. However, Ha/Hb<0.36. Thus, these samples corroded faster than the samples rated as D probably because phenomena such as grain growth occurred and thus resulted in the peeling of the oxide film and intergranular corrosion during the corrosion test.

Samples 42 and 48 were rated as F. For Samples 42 and 48, Cr was present in the front end portion in the second largest proportion and in an amount of 12% by mass or more, the group B was present in a proportion of 0.1% by mass or more, and the front end portion satisfied f/e≤0.15 and m/e≤0.015. As for the crystal grains in the front end portion, X>Y. However, Ha/Hb<0.36, and the group A was present in the tip in a proportion of less than 4% by mass. Thus, these samples corroded faster than the samples rated as E probably because phenomena such as grain growth occurred more easily during the corrosion test, and additionally, the oxide film peeled off due to the stress in the front end portion.

Samples 1 to 5, 22, 23, 44, and 45 (Comparative Examples) were rated as G. For Samples 1 to 3, Cr was present in the front end portion in the second largest proportion and in an amount of 12% by mass or more, the group B was present in a proportion of 0.1% by mass or more, and the front end portion satisfied m/e≤0.004. As for the crystal grains in the front end portion, X>Y, and Ha/Hb≥0.36. The group A was present in the tip in a proportion of 4% by mass or more. However, f/e>0.15. Thus, the front end portion fractured due to corrosion probably because the oxide film had insufficient density.

For Samples 4 and 5, the front end portion satisfied f/e≤0.04 and m/e≤0.004, and the group B was present in a proportion of 0.1% by mass or more. As for the crystal grains in the front end portion, X>Y, and Ha/Hb≥0.36. The group A was present in the tip in a proportion of 4% by mass or more. However, Cr was present in the front end portion in a proportion of less than 12% by mass. Thus, the front end portion fractured due to corrosion probably because an insufficient amount of oxide film formed.

For Samples 22 and 23, Cr was present in the front end portion in the second largest proportion and in an amount of 12% by mass or more, and the group B was present in a proportion of 0.1% by mass or more. As for the crystal grains in the front end portion, X>Y, and Ha/Hb≥0.36. The group A was present in the tip in a proportion of 4% by mass or more. For Sample 22, the front end portion satisfied m/e≤0.004; however, f/e>0.15. For Sample 23, the front end portion satisfied f/e≤0.001; however, m/e>0.015. For Samples 22 and 23, the front end portion fractured due to corrosion probably because the oxide film had insufficient density and continuity.

For Samples 44 and 45, Cr was present in the front end portion in the second largest proportion and in an amount of 12% by mass or more, and the front end portion satisfied f/e≤0.15 and m/e≤0.015. As for the crystal grains in the front end portion, X>Y. However, Ha/Hb<0.36, and the group A was present in the tip in a proportion of less than 4% by mass. Additionally, the front end portion was essentially free of group B elements. Thus, for Samples 44 and 45, the front end portion fractured due to corrosion probably because no group B oxide or nitride film formed.

Example 2

The tester prepared various samples that were identical to Samples 42 and 48 except that the distance D varied. These samples had distances D of 23 mm, 22 mm, 19 mm, 18 mm, 15 mm, 14 mm, and 7 mm. For comparison, a sample having the same composition as Sample 2 where D=23 mm was prepared. After each sample was subjected to the 1,000 cycles of operation of the corrosion test described in Example 1, the corrosion thickness of the front end portion was measured as in Example 1.

As a result, with the corrosion thickness of Sample 2 (Comparative Example) at D=23 mm being 1, the corrosion thickness of Sample 42 (Example) was as follows: 1.3 at D=22 mm, 1.4 at D=19 mm, 1.6 at D=18 mm, 2.0 at D=15 mm, 2.3 at D=14 mm, and 3.9 at D=7 mm. Similar results were obtained from Sample 48 (Example). It was found for both samples that the corrosion thickness increased as the distance D became shorter. As the distance D becomes shorter, the front end portion undergoes a larger temperature change, and therefore, the oxide film on the front end portion peels off more easily. Thus, it is obvious that it is more effective to apply the present invention as the distance D becomes shorter.

Although the present invention has been described by reference to the foregoing embodiment, this embodiment should not be construed as limiting the scope of the invention in any way. It can be easily understood that various improvements and modifications can be made without departing the spirit of the invention.

Although Y and La were used as rare earth elements in the examples described above, they need not necessarily be used. The front end portion may of course contain other rare earth elements.

Although the cylindrical tip 27 is used in the embodiment described above, it need not necessarily be used; other shapes may of course be employed. Examples of other shapes of the tip 27 include truncated cones, elliptic cylinders, and prisms such as triangular prisms and quadrangular prisms.

Although the inner gasket 38 is disposed between the stepped portion 33 of the metal shell 30 and the stop portion 15 of the insulator 11 in the embodiment described above, it need not necessarily be used. The inner gasket 38 may of course be omitted, with the stepped portion 33 of the metal shell 30 being in direct contact with the stop portion 15 of the insulator 11.

Although the tip 27 is joined to the front end of the base material 23 of the center electrode 20 in the embodiment described above, they need not necessarily be joined in this manner. An intermediate material formed of a Ni-based alloy may of course be disposed between the base material 23 and the tip 27. In this case, the front end portion corresponds to the portions of the intermediate material and the base material located forward of the front end 16 of the insulator 11. The intermediate material and the base material may have different compositions.

Having described the invention, the following is claimed:

1. A spark plug comprising:

an insulator having formed therein an axial hole extending from front to rear in a direction along an axial line, the insulator including a stop portion overhanging radially outward;

a metal shell disposed around the insulator and including a stepped portion protruding radially inward, the stepped portion stopping the stop portion from a front side thereof directly or with another member therebetween; and a center electrode disposed in the axial hole, the center electrode including a front end portion located forward of a front end of the insulator and a tip welded to the front end portion with a fused portion therebetween, wherein the front end portion contains Ni, Cr, and at least one element selected from a group B consisting of Mn, Si, Al, Ti, rare earth elements, Hf, and Zr, Ni being present in the largest proportion, Cr being present in the second largest proportion and in an amount of 12% by mass or more, the at least one element selected from the group B being present in a total amount of 0.1% by mass or more, the front end portion satisfying $f/e \leq 0.15$ and $m/e \leq 0.015$, where f is an Fe content, e is a sum of Cr, Si, and Al contents, and m is a Mo content, and wherein the spark plug has a distance D of 22 mm or less in the direction along the axial line from a first point located at a frontmost position of a boundary between an outer surface of the front end portion and an outer surface of the fused portion to a second point located at a frontmost position of a contact area between the stepped portion or the other member and the stop portion.

2. The spark plug according to claim 1, wherein the tip contains Ir in the largest proportion and at least one element selected from a group A consisting of Pt, Ru, Rh, and Ni in an amount of 4% by mass or more.

3. The spark plug according to claim 1, wherein the front end portion has a region where a plurality of crystal grains appear in a cross-section containing the axial line, a length of the crystal grains in the region in the direction along the axial line is longer than a length of the crystal grains in the region in a direction perpendicular to the axial line, and the front end portion satisfies $Ha/Hb \geq 0.36$, where Ha is a Vickers hardness of the region in the cross-section after heat treatment at 900° C. in an Ar atmosphere for 50 hours, and Hb is a Vickers hardness of the region in the cross-section before the heat treatment.

4. The spark plug according to claim 1, wherein the distance D is 18 mm or less.

5. The spark plug according to claim 1, wherein the distance D is 14 mm or less.

6. The spark plug according to claim 1, wherein $f/e \leq 0.04$.

7. The spark plug according to claim 1, wherein $m/e \leq 0.004$.

8. The spark plug according to claim 1, wherein $f/e \leq 0.001$.

* * * * *